US007699485B1

(12) United States Patent
Lagassey

(10) Patent No.: US 7,699,485 B1
(45) Date of Patent: Apr. 20, 2010

(54) ILLUMINATION DEVICE MOUNTABLE TO A CLOTHING OBJECT

(75) Inventor: Paul J. Lagassey, Vero Beach, FL (US)

(73) Assignee: KoolLight, LLC, Vero Beach, FL (US)

( * ) Notice: Subject to any disclaimer, the term of this patent is extended or adjusted under 35 U.S.C. 154(b) by 205 days.

(21) Appl. No.: 11/845,092

(22) Filed: Aug. 27, 2007

(51) Int. Cl.
*F21V 21/08* (2006.01)

(52) U.S. Cl. ..... 362/103; 362/105

(58) Field of Classification Search ..... 362/103, 362/105, 190, 191, 427
See application file for complete search history.

(56) References Cited

U.S. PATENT DOCUMENTS

| | | | | |
|---|---|---|---|---|
| 1,109,415 | A | 9/1914 | Harris | |
| 1,914,429 | A | 6/1933 | Houlihan et al | |
| 2,234,995 | A | 3/1941 | Waechter | |
| D127,785 | S | 4/1941 | Brodton | |
| 2,539,104 | A | 1/1951 | Rodel | |
| D176,073 | S | 11/1955 | Mantell | |
| 3,032,647 | A | 5/1962 | Wansky et al | |
| D214,943 | S | 8/1969 | Zapolski | |
| 3,731,084 | A * | 5/1973 | Trevorrow | 362/108 |
| D238,958 | S | 2/1976 | Feinbloom | |
| D266,192 | S | 9/1982 | Feinbloom et al. | |
| D274,758 | S | 7/1984 | Shing | |
| D275,523 | S | 9/1984 | Ader | |
| 4,727,603 | A * | 3/1988 | Howard | 2/115 |
| D296,719 | S | 7/1988 | Lester | |
| 4,794,496 | A | 12/1988 | Lanes et al. | |
| D300,868 | S | 4/1989 | Conforti | |
| 4,827,384 | A | 5/1989 | Von Schlemmer | |
| 4,916,596 | A | 4/1990 | Sharrah et al. | |
| 4,945,458 | A | 7/1990 | Batts et al. | |
| D318,338 | S | 7/1991 | Mitchell | |
| D320,667 | S | 10/1991 | Smith | |
| 5,115,382 | A * | 5/1992 | Smith | 362/105 |
| 5,117,510 | A | 6/1992 | Broussard et al. | |
| 5,154,483 | A | 10/1992 | Zeller | |
| 5,183,193 | A * | 2/1993 | Brandell | 224/219 |
| D337,838 | S | 7/1993 | Van Der Bel | |
| 5,363,291 | A | 11/1994 | Steiner | |
| D362,080 | S | 9/1995 | Lehrer et al. | |
| 5,463,538 | A | 10/1995 | Womack | |
| 5,541,816 | A * | 7/1996 | Miserendino | 362/106 |
| D373,433 | S | 9/1996 | Feinbloom | |
| D383,229 | S | 9/1997 | Kiichiro | |
| 5,680,718 | A | 10/1997 | Ratcliffe et al. | |
| 5,709,462 | A * | 1/1998 | Rumpel | 362/237 |
| 5,738,431 | A | 4/1998 | Lary | |
| 5,741,060 | A | 4/1998 | Johnson | |
| 5,743,621 | A | 4/1998 | Mantha et al. | |
| D399,580 | S | 10/1998 | Feinbloom | |

(Continued)

*Primary Examiner*—Sandra L O'Shea
*Assistant Examiner*—Evan Dzierzynski
(74) *Attorney, Agent, or Firm*—Hoffberg & Associates

(57) ABSTRACT

A light adapted to be attached to an article of clothing, comprising a power supply casing, an illuminator casing, having therein an illuminator adapted to emit a beam of light when electrically powered, said power supply casing and illuminator casing being attachable and detachable to the article of clothing means of a clamping force applied by a clamp with at least one extension, said at least one extension providing mechanical interconnection and a clamping force between the light and the article of clothing to retain the article of clothing therebetween.

18 Claims, 10 Drawing Sheets

U.S. PATENT DOCUMENTS

| | | | | |
|---|---|---|---|---|
| D405,202 | S | 2/1999 | Fattori et al. | |
| 5,894,604 | A | 4/1999 | Crabb et al. | |
| D426,330 | S | 6/2000 | Cramer | |
| 6,183,116 | B1 | 2/2001 | Harter et al. | |
| D447,586 | S | 9/2001 | Shing | |
| 6,457,838 | B1 * | 10/2002 | Dugmore et al. | 362/106 |
| 6,467,929 | B2 | 10/2002 | Lee | |
| 6,634,031 | B1 | 10/2003 | Schlapkohl | |
| 6,733,150 | B1 | 5/2004 | Hanley | |
| D491,713 | S | 6/2004 | Wilson | |
| 6,752,511 | B1 | 6/2004 | Cramer | |
| 6,808,289 | B2 * | 10/2004 | Reed | 362/198 |
| 6,895,602 | B2 * | 5/2005 | Schlapkohl | 2/209.13 |
| D506,560 | S | 6/2005 | Oas | |
| 6,932,487 | B2 * | 8/2005 | Aknine | 362/106 |
| 7,086,749 | B1 | 8/2006 | Hanley | |
| 7,131,745 | B2 * | 11/2006 | Sibbett | 362/106 |
| 7,611,255 | B1 * | 11/2009 | Lagassey | 362/103 |
| 2002/0163800 | A1 * | 11/2002 | Hansen | 362/103 |
| 2004/0252487 | A1 * | 12/2004 | McCullough et al. | 362/105 |
| 2007/0192934 | A1 * | 8/2007 | Niedrich et al. | 2/171 |

* cited by examiner

FIG. 5A
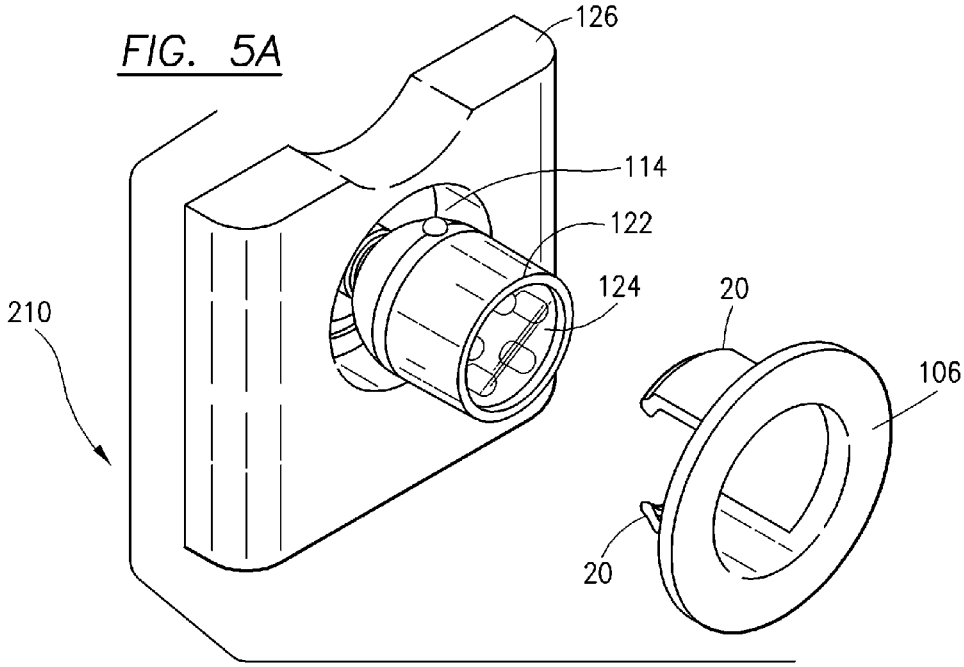
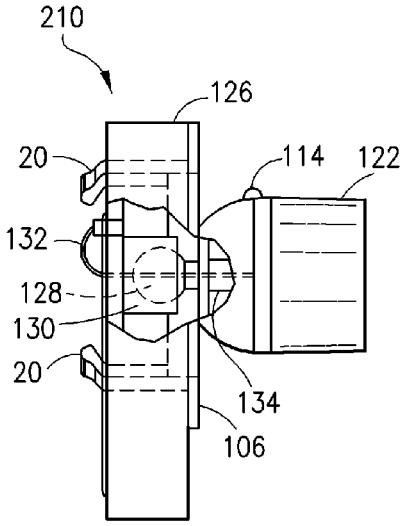
FIG. 5B
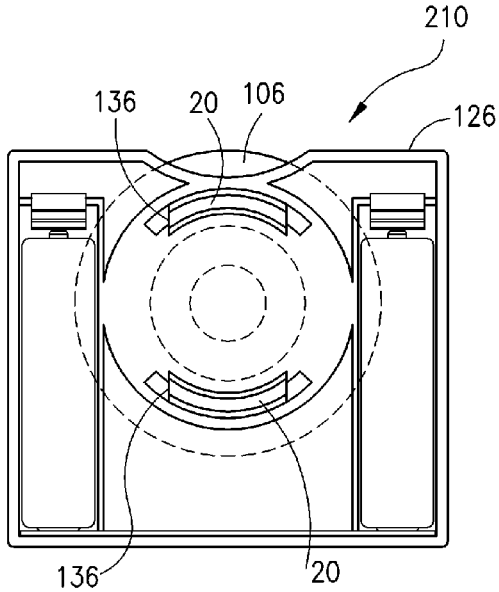
FIG. 5C

ILLUMINATION DEVICE MOUNTABLE TO A CLOTHING OBJECT

BACKGROUND OF THE INVENTION

1. Field of the Invention

This invention relates to an illumination device which is mountable through an aperture in a sheet of material, which, for example, is an object of clothing, such as a hat, shirt or jacket, for example an incandescent lamp, light emitting diode (LED) or an array of LEDs within a housing which may be mounted through a hole in an article of clothing, to provide lighting for a wearer.

2. Description of Related Art

Portable lights have been used in the past with garments, including lights attached to headgear or other garment articles for illumination purposes. Based on its usage such as in a hat (or on a garment), the size, weight, weight distribution and access to the battery pack become characteristics that affect the overall usability of the portable light. See, U.S. D426,330; D127,785; D176,073; D214,943; D238,958; D275,523; D296,719; D300,868; D318,338; D320,667; D337,838; D362,080; D373,433; U.S. Pat. No. 2,234,995, D506,560; D399,580; D266,192; U.S. Pat. No. 2,539,104; D383,229; D491,713; D405,202; D447,586; D274,758; U.S. Pat. Nos. 1,109,415; 1,914,429; 3,303,647; 3,032,647; 5,363,291; 5,541,816; 5,738,431; 5,741,060; 5,743,621; 6,183,116; 6,895,602; 6,467,929; 6,634,031; 5,680,718; 4,945,458; 4,916,596; 1,109,415; 4,827,384; 7,086,749; 6,733,150; 6,752,511; 6,932,487; 5,463,538; 5,154,483; 5,117,510; 4,794,496; 6,932,487; and 5,894,604, each of which is expressly incorporated herein by reference.

In headwear, any torque due to unbalanced masses may lead to sagging or slipping of the gear or object in which it is mounted out of alignment. Likewise, large batteries or other massive structures are undesirable. Protruding portions of the system, such as battery housings, lamp reflector housings, and the like, on the inside of a clothing object, may be uncomfortable. Adjustment opportunities for the beam axis on a clothing object has been limited in prior designs.

Various prior art light modules designed to clip or otherwise attach to clothing or headgear can become separated during use, or light modules attached to a head strap, may not stay in place or may be cumbersome and uncomfortable.

Another problem faced by the art is the switching mechanism, particularly in hat embodiments where the switch may be unseen by the user when sought to be actuated.

SUMMARY OF THE INVENTION

The present invention provides an illuminator, which preferably forms a light beam which may be aligned with the field of view of the wearer, which is attached through an aperture by a clip or other means, to a sheet of fabric, which is typically an article of clothing, such as a hat, shirt or jacket.

The illuminator preferably has a power source, which may be within an integral housing with the light emitter, or separated from the light emitter, for example connected through a cable.

The illuminator may be switched on and off, in certain embodiments, by manipulation of an illuminator subhousing with respect to a supporting structure, for example by means of a switch, rotation, or altering an inclination or axial angle of the subhousing.

In one embodiment, the design has a low profile, with the batteries placed unobtrusively in a compartment next to the body of a wearer, within an article of clothing, and the entire housing in this compartment is only slightly larger than the thickness the battery. Therefore, the illumination control is preferably not on a hidden portion of this compartment, since this may make actuation difficult. On the other hand, the illumination emitter is generally visible and available, making a control associated with this component attractive. In some instances, in spite of the generally forward field of illumination of the illuminator, it is desired to adjust the direction and/or breadth of the field of illumination, and thus some embodiments provide an adjustable axis of illumination and/or field of illumination.

The illumination source may be, for example, an incandescent bulb, e.g., a 3-4.5V halogen lamp, an LED or LED cluster, e.g., a set of white LED's to provide appropriate illumination, an electrical discharge and/or fluorescent bulb, a fiber optic illuminator, or other source.

The power source is preferably a pair of 1.5 V AA or AAA batteries, but LED illuminators and LED clusters particularly lend themselves to 3 V lithium coin cells, e.g., type CR2032, CR2430 or CR2450 batteries. This permits direct drive of the LED or LED cluster from the unregulated output of the batteries, simplifying the circuit. Of course, a regulated voltage design could also be employed. Preferably, a voltage-converter or other driver circuit is employed to drive a set of LEDs. This decouples, in part, the drive voltage of the LEDs from that directly available from the power source. Preferably, the drive circuit is integral with the circuit for mounting the LEDs, providing a two wire interface from the power supply to the LED support and driver circuit. Likewise, it is preferred that the subhousing holding the LED support and driver circuit be switched based on an intermittent supply of current through one or both of the supply wires, effecting a switch mechanism.

In preferred instances, the aperture in the article of clothing is specifically adapted to hold the illumination device, for example a circular hole, a keyed generally circular hole, or a reinforced slit (e.g., similar to a buttonhole) which may have reinforced edges. In other embodiments, an illuminator subhousing is located external to the article, while the power supply subhousing is located internal or external to the article. In the case where the components are separated, the two components may be connected by one or more extensions, which provide electrical connection and mechanical support. In the case where both are collocated, the perforation provides mechanical support only. The aperture may be, for example, a button hole, adapted to pass a connecting member therethrough. The illumination device may therefore be clamped to the material surrounding the aperture, to hold the illumination device securely in place.

According to a first embodiment, the power supply subhousing has a pivot with a set of slip ring electrical connections, to support the illuminator subhousing which extends through a circular aperture in the clothing. A clamp is provided which extends around the illuminator subhousing, which holds the power supply tightly against the fabric of the clothing. The switch mechanism is integrated into the slip ring connector, which in one position, e.g., above vertical, is open circuit, but in other angles forms a complete circuit which illuminates the device. In general, a working position for the illuminator is one in which the illuminator subhousing is inclined somewhat below vertical. This embodiment allows the angle of the light beam to be adjusted to any position below vertical during operation. Alternative methods for switching power on/off include a separate mechanical switch such as a push button, slider switch or rotation of the exterior part of the illuminator subhousing. An alternate embodiment employs a ball and socket, in which a wire or wire extends up a hollow shaft to provide an electrical path with another wire or a conductive shaft. In this case, the switch may be operated by mechanical contact with a leaf switch mechanism based on an angle of the ball and socket (or mechanically linked structures) or a separate switch element. Alternatively, the ball and socket mechanism may serve as a switching mechanism by placing contacts in the ball and socket in a configuration such that contact is opened and closed by rotating or angling the light module so the contact on the ball makes or breaks connection with the contact in the socket. This ball and socket design allows the light beam angle to be adjusted in two dimensions.

According to a second embodiment, both the power supply and illuminator subhousings are provided external to the article of clothing, and these two components may be integrated into one unit. In this case, similar to the second embodiment, a set of standoffs are provided which extend through perforations in the clothing, and attach to a retaining clip. In this case, of course, the standoffs are not electrically operative.

According to a third embodiment, a fiber optic or fluid optic conduit is provided, wherein an illumination source is internal, disposed within a housing, and a conduit or fiber is provided to selectively guide the light where needed. The system may thus make use of fiber optics and/or optic conduits, e.g., fluidic light guides (liquid core light guide), which permit the illuminator to be removed from the physical location of the desired illumination point. For example, a fluidic light guide may be provided from an internal light source, such as a high intensity LED, wherein the fluidic light guide may extend within a gooseneck structure to maintain its desired orientation after positioning. The advantage of such an embodiment can be a minimal protrusion of the light source on the outside portion of the clothing item.

According to one implementation of the invention, an optional power socket is provided to power an auxiliary device, such as an MP3 player or cell phone. Further, the clothing may be provided with an optional pocket for holding the auxiliary device. For example, a hat is provided with an illumination device in the front thereof. Internally or externally, a socket is provided which taps the power from the power supply, e.g., 3VDC, which passes through a cable to the auxiliary device. The power supply may include rechargeable batteries, in which case the same or a different connector may be used for recharging. Likewise, the power supply may be used to charge rechargeable batteries in the auxiliary device. The auxiliary device may be maintained within a pocket or recess, or beneath a band, in the hat.

According to another implementation of the invention, a camera and/or a microphone may be mounted in addition to, or in place of the illuminator, or these may be concealed within the illuminator casing. This camera and/or microphone units may be wireless for sending and remotely saving video and audio taken by the wearer, or may be saved within a memory module located within the illuminator casing, power supply casing or disposed in a location on the article of clothing or hat. The illuminator is preferably aligned with the lens axis, so that the illuminator effectively illuminates the scene. In some cases, the illumination may be infrared, and the camera responsive to infrared.

One embodiment provides a portable light that can be easily attached to a textile or fabric (found in a hat or other garment) that includes a housing for storing batteries (either rechargeable or disposable) and a separable lighting unit that includes an illumination source, for example a light bulb, a light on/off switch, the reflector, a reflector cover and a fabric clamping unit having at least one prong that clamps into the battery housing for securing said battery housing and light to said textile or fabric. The housing may also contain a connection for receiving power from and/or providing power to an external device.

A portable light unit is provided that can be readily secured to a textile or fabric such as a hat comprising a an illuminator sub-housing separably connected to a power supply casing which may contain at least one battery or be connected to a power supply such as battery case. In a preferred embodiment, the power supply casing is a flat, thin somewhat rectangular container for receiving one or more batteries, said battery case including electrodes for positive and negative contacts with each of the batteries stored in the battery case, said electrical contacts being connected to a plurality of wires terminating in series to a pair of electrodes mounted near the center of said battery case. The power supply casing may include a pair of female electrical receptacle slots in the outside wall that engage with the electrode mounting structure of the lighting unit and also function as electrodes to the battery case.

The lighting unit includes a transparent cover plate and a body, which in some embodiments serves as a reflector that has, for example, one or more light bulbs or LEDs mounted therein for illumination and a pair of conductors coming from the base of the lighting unit.

The lighting unit mounting plate has one or more rigid coupling connectors protruding approximately perpendicular out one side. The coupling connections may be partially plated or provided with a set of separate conductors to provide positive and negative electrodes. Which directly, or through other structures, provide power to the illuminator.

The illumination subhousing may have mounting prongs which are curved at their end tips, so that they can be secured resiliently inside engaging slots in the power supply subhousing so that they provide a strong retaining force, yet may be selectively disengaged and reengaged without breakage. In normal operation, the lighting unit is secure at all times, regardless of the normal forces on the clothing article. The power supply may be accessible from the inside of the article of clothing for changing batteries when necessary.

It is therefore an object to provide a light unit adapted to be attached to an article of clothing, comprising a power supply casing adapted to hold at least one of a battery and a connector adapted to interface with an external battery, providing electrical connections thereto; an illuminator casing, having therein an illuminator adapted to emit a beam of light when electrically powered; an electrical switch, adapted to selectively interrupt power from the power supply casing to the illuminator; the power supply casing and the illuminator casing being attachable and detachable by means of at least one extension, the at least one extension providing mechanical interconnection and a clamping force between the power supply casing and the illuminator casing to retain the article of clothing therebetween, an electrical connector mechanism, automatically providing an electric circuit between the power supply casing and the illuminator casing when the at least one extension attaches the power supply casing and the illuminator.

The at least one extension may comprise a pair of members having snaps which mate to corresponding recesses, wherein the snaps are inserted in the recesses to provide a mechanical connection. The electrical connector mechanism may be integral with the at least one extension. The at least one extension may comprise at least two extensions, and the electrical connector mechanism is integral with the at least two extensions, wherein a portion of a current path is provided by each of a pair of the extensions. The article of clothing may comprise a hat having a recess adapted to hold an auxiliary device, and wherein the power supply casing comprises an electrical connector adapted to mate with the auxiliary device. The auxiliary device may draw power from the power supply casing. The auxiliary device may supply power to the power supply casing. The at least one extension may be attachable and detachable by mutual rotation. The battery has a defined thickness, and a thickness of the power supply casing being approximately no greater than the sum of thickness of the battery, a wall thickness of the power supply casing, and a thickness of a mechanical interconnection portion of the power supply casing. The power supply casing may comprise a connector adapted to interface with an external battery, further comprising an external battery housing and a power cable interconnecting the external battery housing and the power supply casing.

It is a further object to provide a method of providing illumination from an article of clothing, comprising providing a power supply casing adapted to hold at least one of a battery and a connector adapted to interface with an external battery, providing electrical connections thereto, an illuminator casing, having therein an illuminator adapted to emit a beam of light when electrically powered, and an electrical switch, adapted to selectively interrupt power from the power supply casing to the illuminator; attaching the power supply casing to the illuminator casing by mechanically engaging at least one extension, to provide a clamping force between the power supply casing and the illuminator casing to retain the article of clothing therebetween, and automatically providing an electric circuit between the power supply casing and the illuminator casing; and detaching the power supply casing to the illuminator casing by mechanically disengaging the at least one extension.

It is a still further object to provide a light adapted to be attached to an article of clothing, comprising a power supply casing adapted to hold at least one of a battery and a connector adapted to interface with an external battery, providing electrical connections thereto, the battery having a thickness, a thickness of the power supply casing being no greater than approximately sum of the thickness of the battery, a wall thickness of the power supply casing, and a thickness of a mechanical interconnection portion of the power supply casing; an illuminator casing, having therein an illuminator adapted to emit a beam of light when electrically powered, attached to the power supply casing through a coupling which permits the illuminator casing to be moved about at least one axis; an electrical switch, adapted to selectively interrupt power from the power supply casing to the illuminator; a clamp, having at least one extension providing mechanical interconnection and a clamping force with respect to the power supply casing, to retain the article of clothing therebetween, at least a portion of the illuminator casing extending forward of the power supply casing with respect to the article of clothing.

The coupling may provide a horizontal pivot about which the illuminator housing moves. The coupling may also comprise a ball in socket mechanism providing freedom of movement about both horizontal and vertical axes for the illuminator housing. The power supply casing may be adapted to be disposed on an inside portion of the article of clothing, with the illuminator casing providing illumination outside of the article of clothing. The power supply casing may be adapted to be disposed on an outside portion of the article of clothing, the clamp adapted to be positioned inside the article of clothing, with the illuminator casing providing illumination outside of the article of clothing. The power supply casing may comprise a connector adapted to interface with an external battery, further comprising an external battery housing and a power cable interconnecting the external battery housing and the power supply casing.

It is a still further object to provide a light adapted to be attached to an article of clothing, comprising: a power supply casing adapted to hold and electrically connect at least one of a battery and a connector adapted to interface with an external battery, the battery having a thickness, a thickness of the power supply casing if holding a battery being no greater than approximately sum of the thickness of the battery, a wall thickness of the power supply casing, and a thickness of a mechanical interconnection portion of the power supply casing; an illuminator, disposed within the power supply casing, adapted to emit light when electrically powered, attached to the at least one battery; an electrical switch, adapted to selectively interrupt power from the power supply casing to the illuminator; a clamp, having at least one extension providing mechanical interconnection and a clamping force with respect to the power supply casing, to retain the article of clothing therebetween; and a flexible, repositionable optic conduit for guiding light from the illuminator to a port external to the article of clothing.

It is another object to provide a light adapted to be attached to an article of clothing, comprising: an internal casing having a maximum thickness of less than about 0.65 inches; an illuminator casing, having therein an illuminator adapted to emit a beam of light when electrically powered; an electrical switch, adapted to selectively interrupt power to the illuminator; the internal casing being attachable and detachable to the article of clothing through an aperture by means of at least one extension, the at least one extension providing mechanical interconnection and a clamping force between the internal casing and a clamp to retain the article of clothing therebetween.

In accordance with these and other objects which will become apparent hereinafter, the instant invention will now be described with particular reference to the accompanying drawings.

BRIEF DESCRIPTION OF THE DRAWINGS

FIGS. 1A1, 1A2, 1B1, 1B2, 1C, and 1D show various configurations of pivot embodiments.

FIGS. 5A, 5B, and 5C show a front exploded perspective view, a side view and a rear view of a ball-in-socket embodiment.

PREFERRED EMBODIMENTS OF THE INVENTION

FIGS. 1A1 through 5C show embodiments of the invention where the illuminator casing is attached to the power supply casing and the light unit is located on the inside of the article of clothing or hat when mounted. This embodiment provides that the entire light unit remains assembled as one piece, the illuminator casing itself projects forward of the power supply casing and the front surface of the article of clothing or hat through a circular aperture. Moving the illuminator casing to the outside enables a more efficient design of the power supply casing, reducing its thickness and improving comfort for the wearer. This design also enables the direction of the light beam to be adjusted to any vertical position in one variation and in any horizontal or vertical direction in another variation. This is particularly useful when the wearer is facing another person while the light is in use, because the focus of the light beam can be moved away from shining directly in the other person's face.

Referring to FIGS. 1A1, 1A2, 1B1, 1B2, 1C and 1D show various embodiments of the lighting unit wherein the position of the light beam can be adjusted by moving the illuminator casing vertically, and illustrate different designs for connecting the illuminator casing to the power supply casing. In this embodiment, the illuminator casings 82*a*, 82*b*, 82*c* and 82*d* are attached to and moved relatively forward from the power supply casing 84*a*, 84*b*, 84*c* and 84*d*.

Figures 1C, 1D:
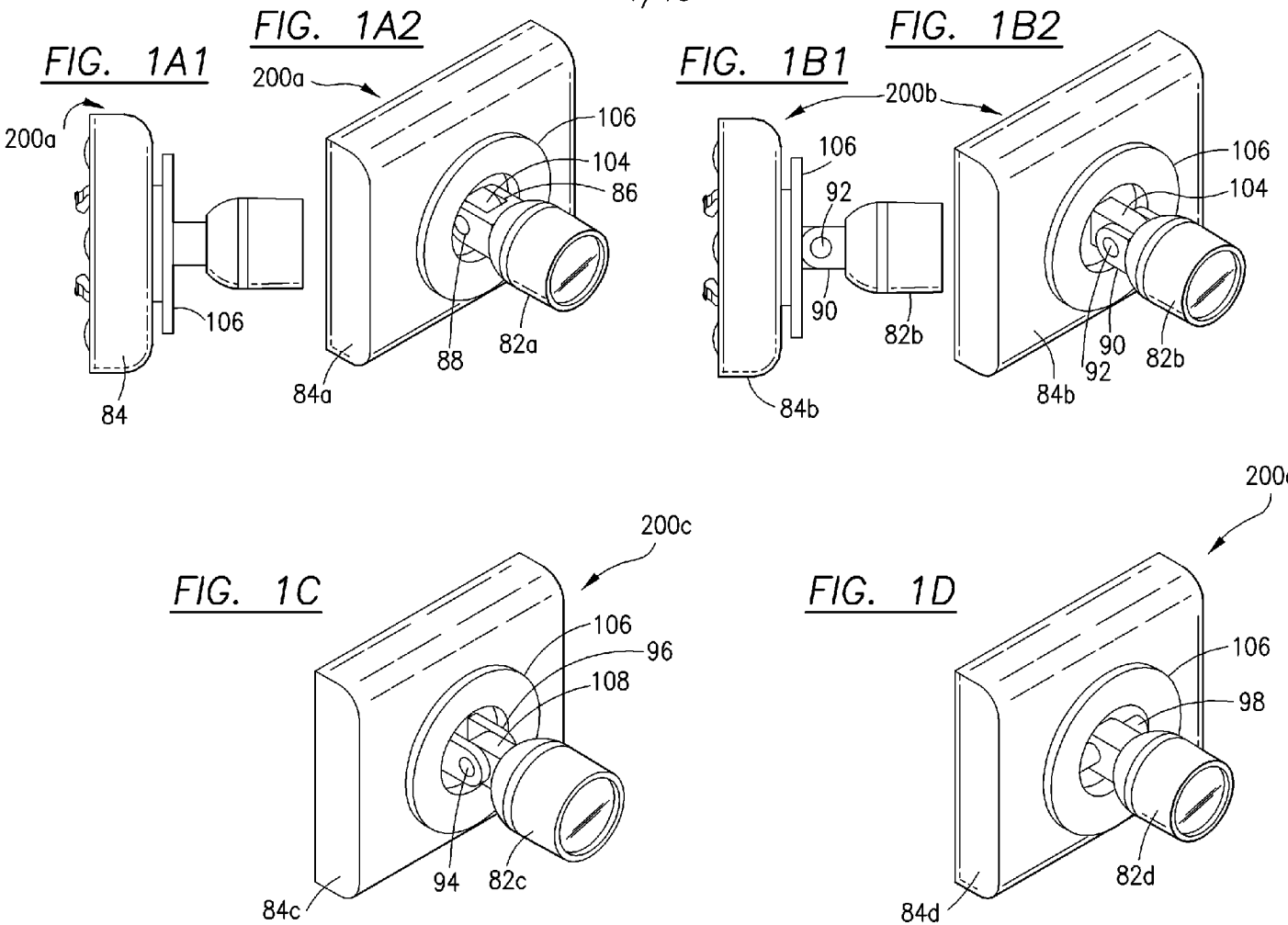

FIGS. 1A1 and 1A2 show a variation of a lighting unit 200*a* wherein the illuminator casing 82*a* has a yoke 86 which pivots about a pin 88, which is passed through the yoke 86 and a hole in the retainer arm 104 which is part of and is disposed within the depth of the power supply casing 84*a*. FIGS. 1B1 and 1B2 show a variation thereof, having a lighting unit 200*b* wherein the illuminator casing 82*b* has a yoke 90 which pivots about a pin 92, which is passed through the yoke 90 and a hole in the retainer arm 104 which is part of, and disposed forward from the power supply casing 84*b*. FIG. 1C shows a variation, having a lighting unit 200*c* wherein the illuminator casing 82*c* has a pin 94 passes through a retainer arm 108 located on the back of the illuminator casing 82*c* which pivots about a yoke 96, which is part of the power supply casing 84*c*. The main difference in this variation is that the yoke 96 is part of the power supply housing 84*c* instead of being part of the illuminator casing 82*c* as in FIGS. 1A1, 1A2, 1*b*1 and 1B2. FIG. 1D shows a variation having a lighting unit 200*d* wherein the illuminator casing 82*d* pivots about a pin 98, which is mounted within the power supply casing 84*d*. In each case, power may be provided to the illuminator from an internal source, through a set of sliding contacts, or through a cable.

Figure 2A:
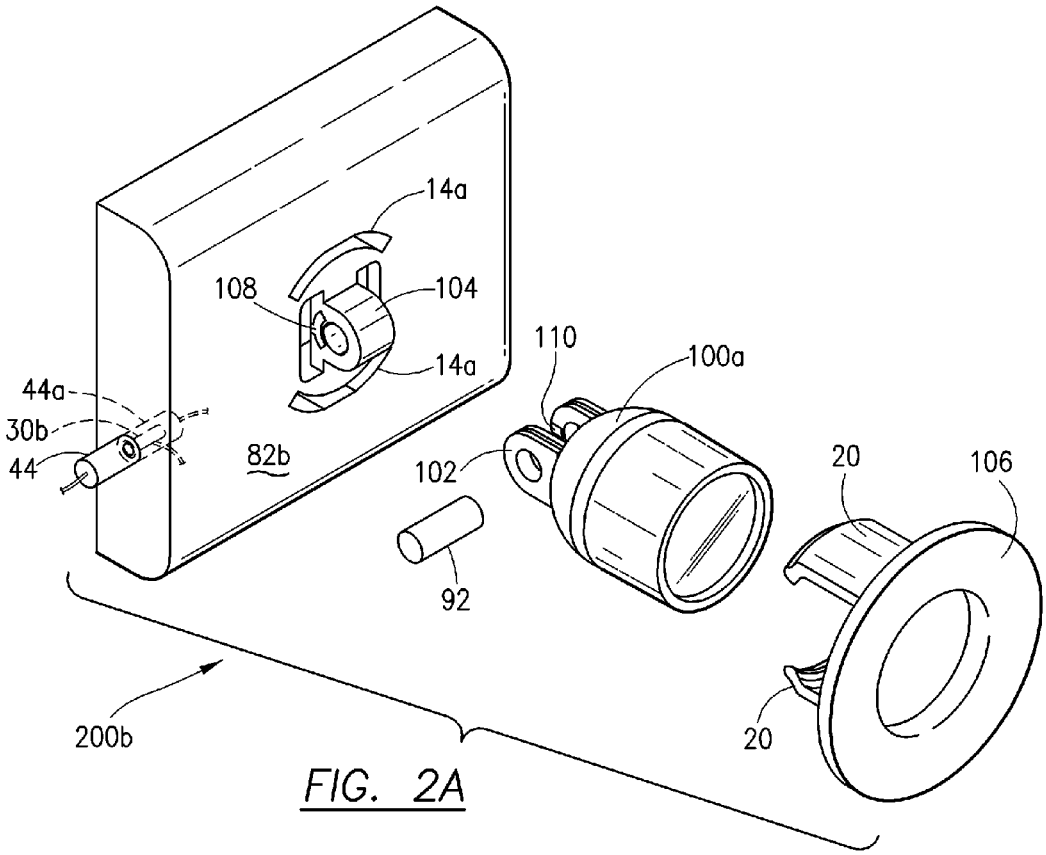
FIGS. 2A, 2B and 2C shows a front perspective exploded view of the embodiment of FIG. 1A with different switch arrangements.
Figure 2B:
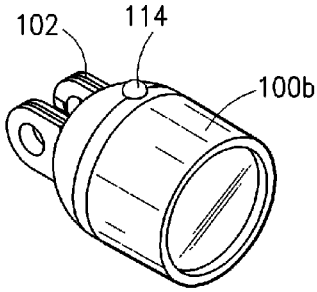
Figure 2C:
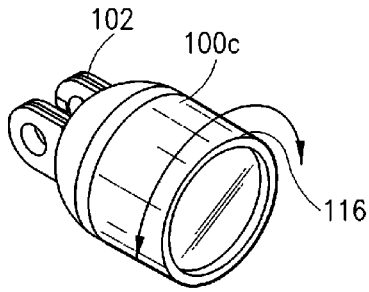

FIGS. 2A, 2B and 2C shows the lighting unit 200*b* with various switching schemes for illuminator casings 100*a*, 100*b*, and 100*c*, which are mounted on a power supply casing 82*b* through a pin 92, which is inserted through the yoke 102 and the retainer arm 104. A plate 106, having prongs 20, engages slots 14*a*, and is used to clamp the light unit 200*b* to an article of clothing or hat providing a connection and support during use. The illuminator casing 100*a* is switched by a mechanism triggered by the angle of the illuminator casing 100*a* on the retainer arm 104. For example, each lateral portion of the yoke 102 has a metallic conductive portion 112, which forms a circuit when it overlays a metallic portion 108, but when moved out of position, the circuit is open. FIG. 2B shows a mechanical switch 114 on the surface of the illuminator casing 100*b*. FIG. 2C shows that the switch may be operated by twisting a portion 116 of the illuminator casing 100*c*.

Figure 3:
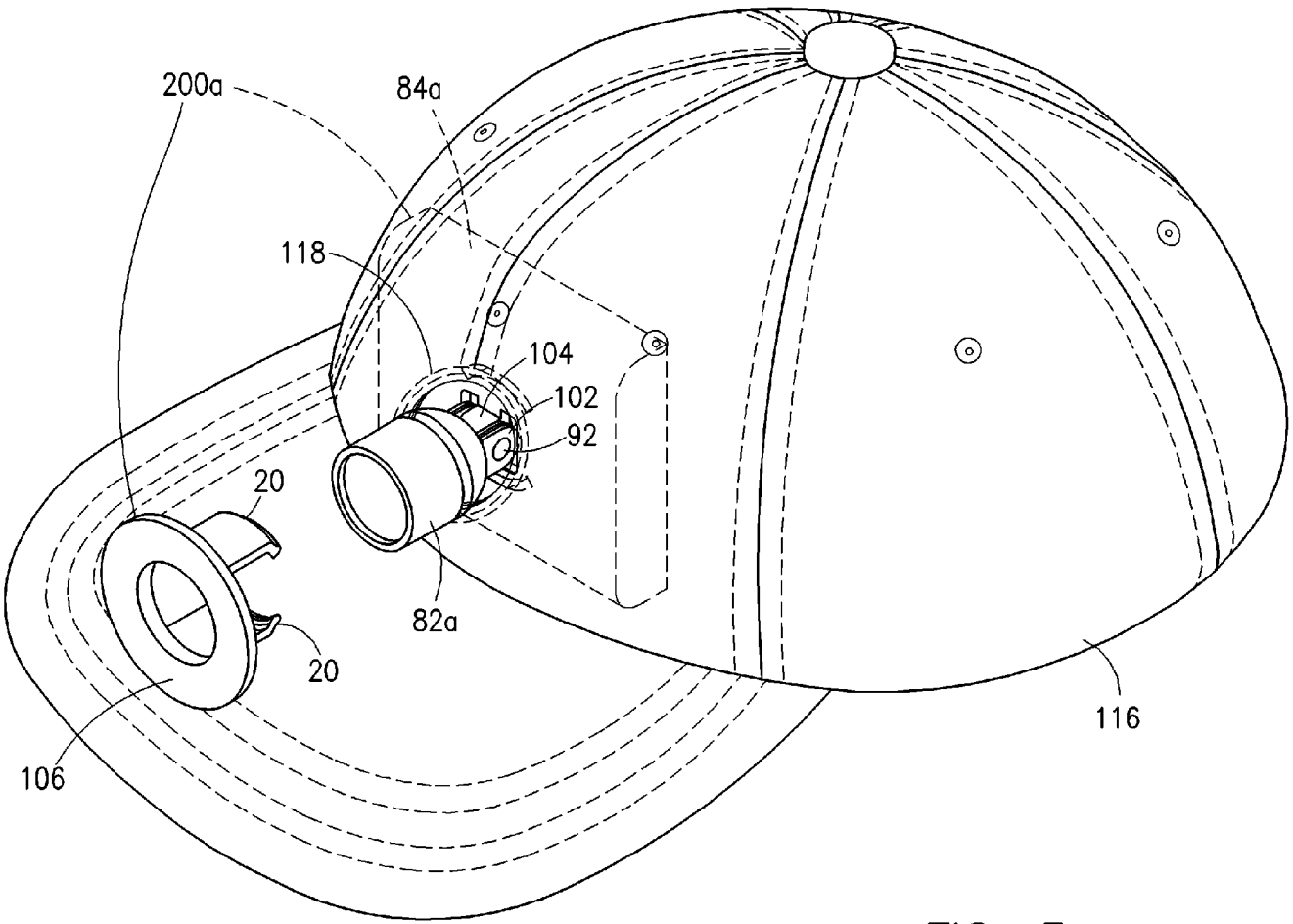
FIGS. 3 and 4 show front perspective exploded views of the embodiments of FIGS. 1A and 1C, respectively, on an article of clothing.
Figure 4:
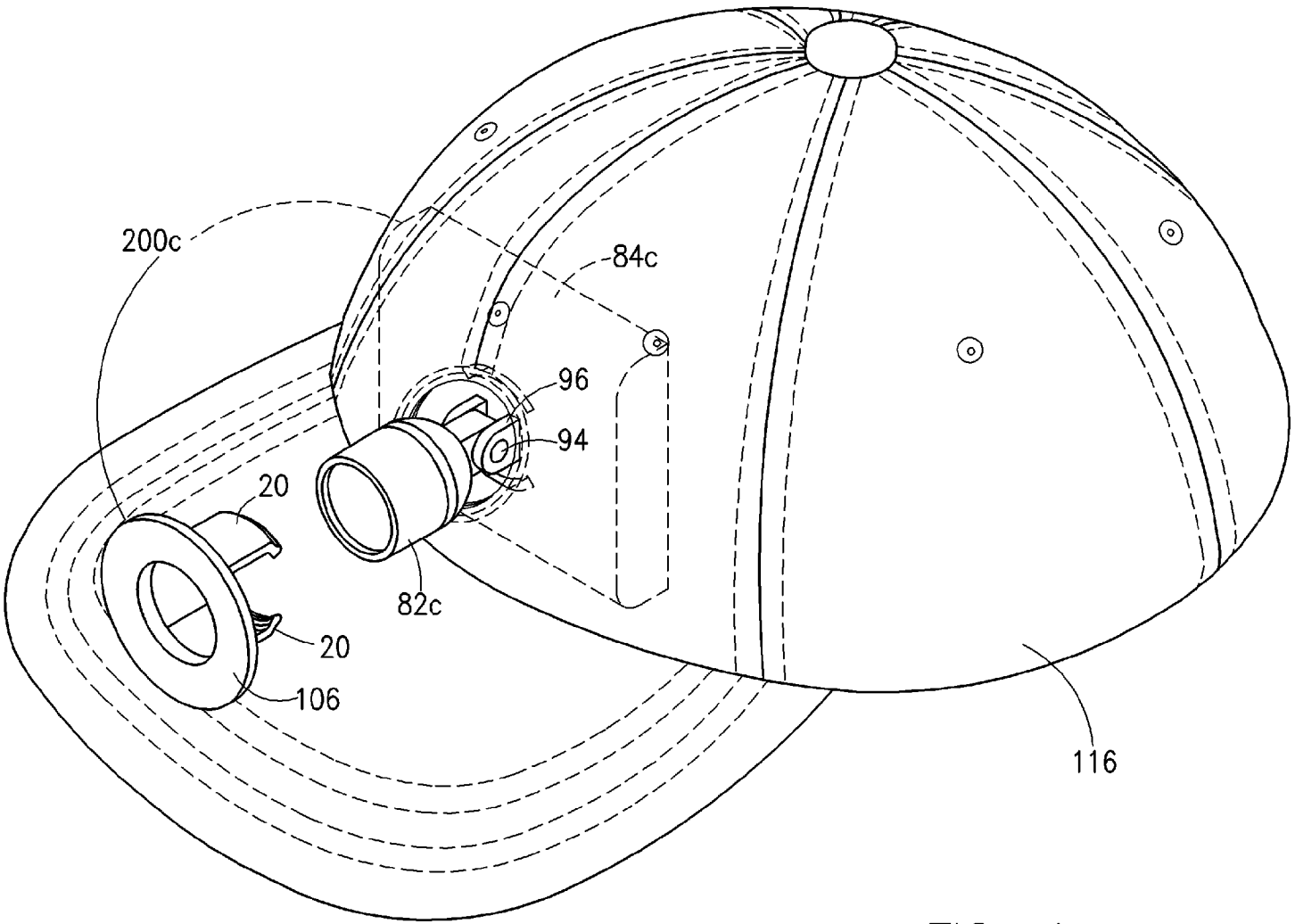

FIGS. 3 and 4 show the placement of a lighting unit 200*a* or 200*c* on a baseball cap 116. In this case, the power supply casing 84*a* or 84*c* is placed within the inside front of the baseball cap 116, with the illuminator casing 82*a* or 82*c* attached to the power supply casing through the yoke 102 and retaining arm 104 by the pin 92. The illuminator casing 82*a* or 82*c* extends through a circular aperture 118 in the baseball cap 116, which, for example, has a cut or reinforced edge, and is clamped in place with plate 106 which has an aperture sufficiently large for it to pass over the illuminator casing 82*a* or 82*c* and prongs 20 to clamp into and secure the lighting unit 200*a* or 200*c* to the baseball cap 116. Of course, the baseball cap 116 can be any article of clothing or type of hat.

FIGS. 5A, 5B and 5C show a further embodiment of the invention. In this case, a lighting unit 210 comprises an illuminator casing 122, with multiple LED illuminators 124, and switch 114. The illuminator casing is mounted to the power supply casing 126 on a ball 128 in socket 130 mount, to provide freedom of movement in both horizontal and vertical directions, with respect to the power supply casing 126. In this case, the ball 128 in socket 130 provides a first conductive path to the LED illuminators 124, while a wire 132 passing through an aperture in the ball 128 and shaft 134 provides the current return path. Alternatively, the design could employ two wires or the ball 128 and socket 130 could each have two connectors. If the latter method of two connectors is used, the current could be switched by rotating the illuminator casing 122 in the ball 128 and socket 130. The power supply casing 126 is affixed to an article of clothing or other sheet with the plate 106 having prongs 20, which are inserted into slots 136. As with the prior embodiment, the plate 106 has an aperture sufficiently large for it to pass over the illuminator casing 122, and article of clothing or other sheet has an aperture through which the prongs 20 and illuminator casing 122 pass. In this embodiment, the illuminator casing 122 is shown with 5 LEDs, however, any number, type or color light may be used. If multiple LEDs are employed, an odd number in a symmetric arrangement, such as 1, 3 or 5 LEDs are preferred.

The embodiments shown in FIGS. 1A1 to 18C particularly lend themselves to be adapted for a single LED and lens configuration designed to emit an intense and broad beam of light. For example, an illumination module similar to that used in the Power Chip LED Flashlight sold by Coast products of Portland Oreg. may be used. The illuminator components of this flashlight comprise a power circuitry, a single LED and a prism reflector lens. The LED is mounted on a driver circuit board which is disposed behind the LED, and the prism reflector is placed over the LED and serves to intensify and focus the beam of light emitted by the LED. Similar components can be used within the illuminator casing to provide a high intensity light beam. Alternately, the LED and prism can be disposed in the illuminator casing and the powering circuitry contained in the power supply casing and connected by wires or other electrical connectors.

Figure 6:
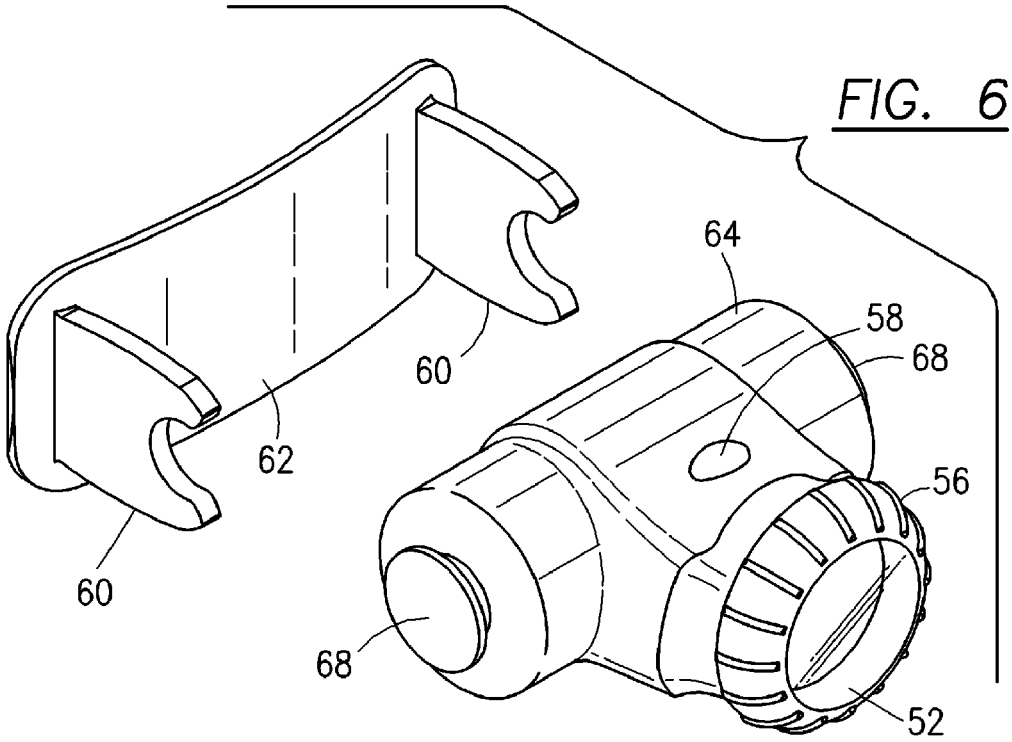
FIG. 6 shows a front perspective exploded view of another embodiment of the invention wherein the power supply casing and the illuminator casing comprise one piece which is disposed outside the article of clothing.
Figure 7:
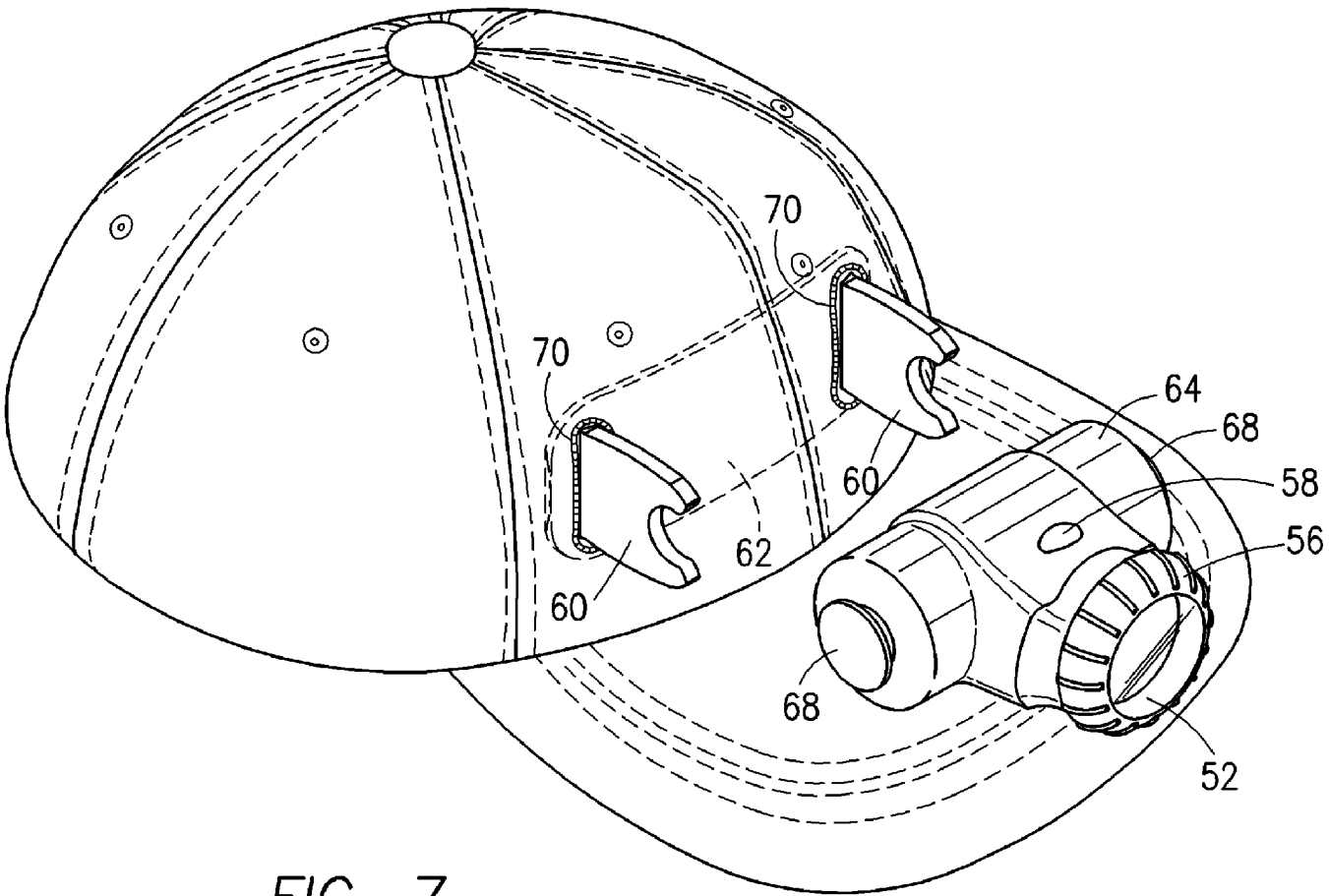
FIGS. 7 and 8 show a front perspective exploded view of the embodiment of FIG. 6 with an article of clothing, and views of the embodiment on a different article of clothing respectively.

FIGS. 6 and 7 show another embodiment in which both the power supply casing 14 and illuminator casing 50 are integrated into one piece which is mounted on the outside of the article of clothing or hat. This embodiment enhances wearer comfort by minimizing the portion of the assembly located on the inside of the article of clothing or hat next to the wearer. Instead of having the prongs 20 extending inward toward the wearer of the article of clothing or hat, a set of prongs 60 extend forward from a mounting 62 located on the inside of the article of clothing or hat 66, to support a lighting unit 64 in front of the article of clothing or hat 66. Advantageously, the prongs 60 engage pivots 68 to allow redirection of the beam of light passing through the lens 52. The rotatable ring 56 can be used as a power switch and/or to focus the pattern of the light beam, or a separate power switch 58 can be used.

As shown in FIG. 7, the cap 66 has a pair of reinforced slot like apertures 70 that resemble button holes corresponding to the prongs 60, which support the lighting unit 64 facing forward. In this embodiment, at least one battery is housed within the lighting unit 64.

Figure 8:
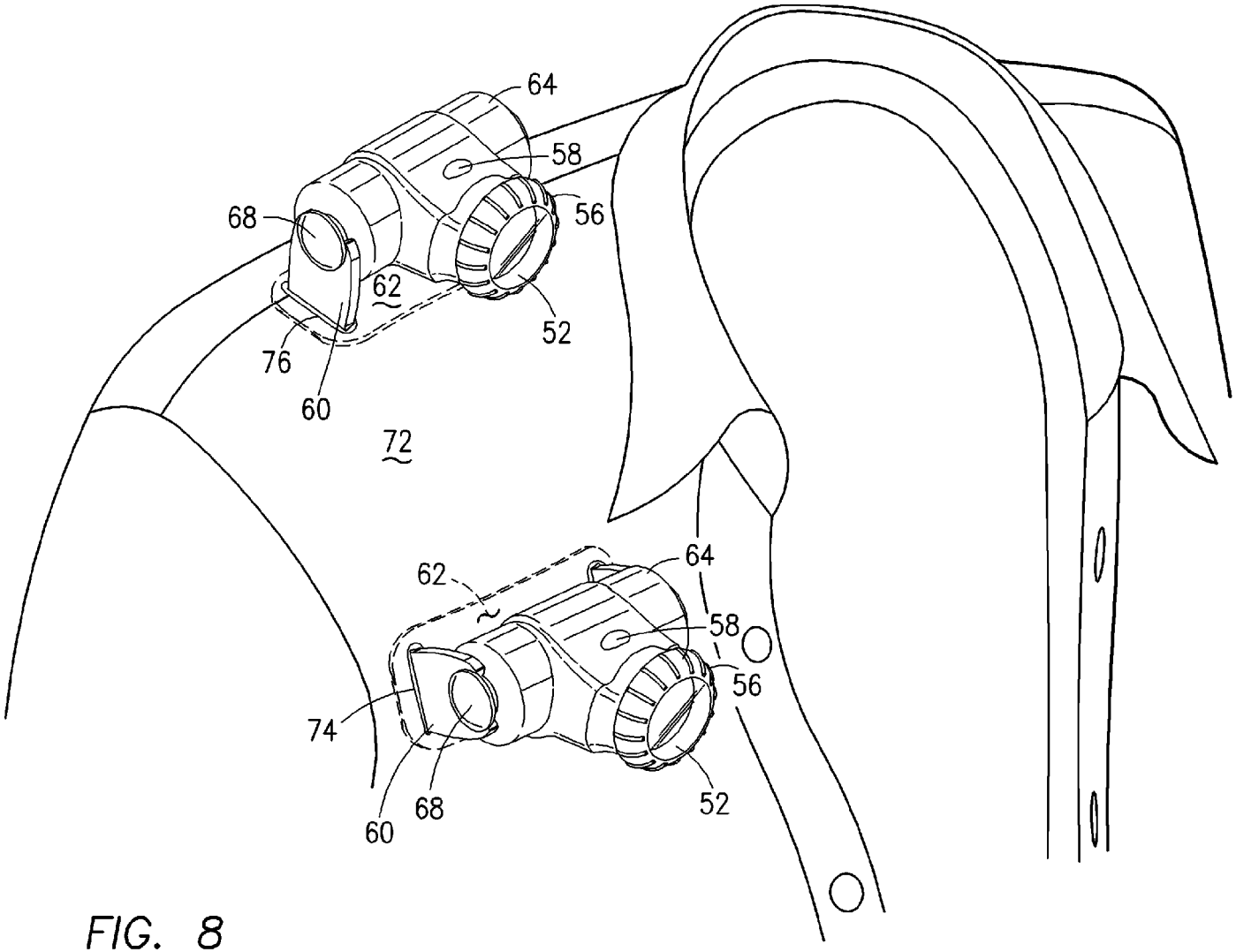

As shown in FIG. 8, the same lighting unit 64 may be supported by other types of clothing articles, such as shirt 72 having sets of apertures 74 and 76, in different locations, such as a pocket or on a shoulder.

Figure 9:
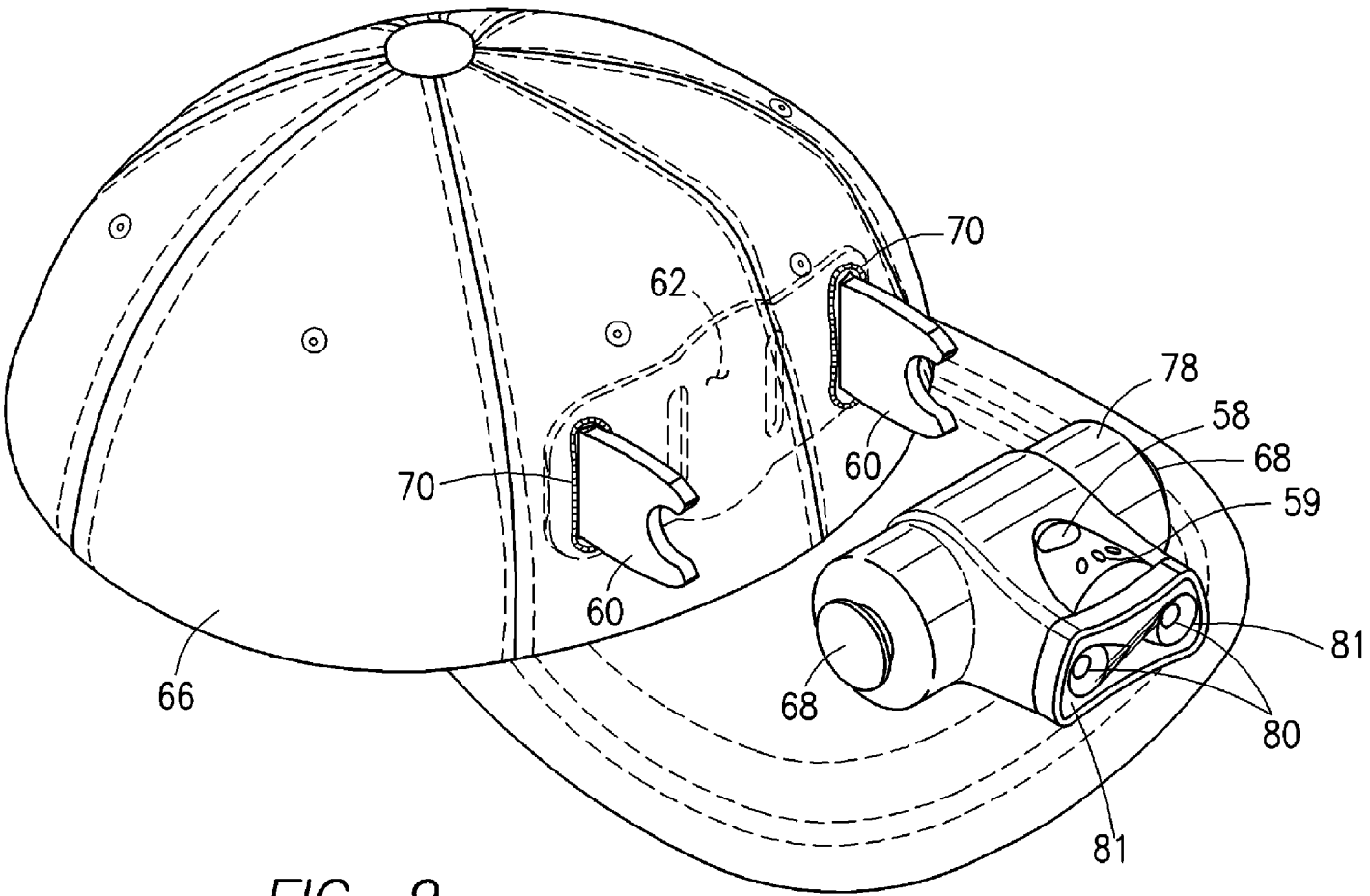
FIG. 9 shows a front perspective exploded view of another embodiment on an article of clothing.

FIG. 9 shows an embodiment with a different lighting unit 78, which for example uses LEDs 80 and a lens or lenses to magnify and/or focus the LED 80 light beam. The light beam may be switched to different intensities or colors, and other optional lights or LED's 59 can be used to indicate the status of the system. With this embodiment, as with others, other electronic devices may also be housed within the same lighting unit 78 module, for example a camera or video camera, audio recorder, or the like. Indeed, in some cases, the lighting function itself is optional.

Figure 10A:
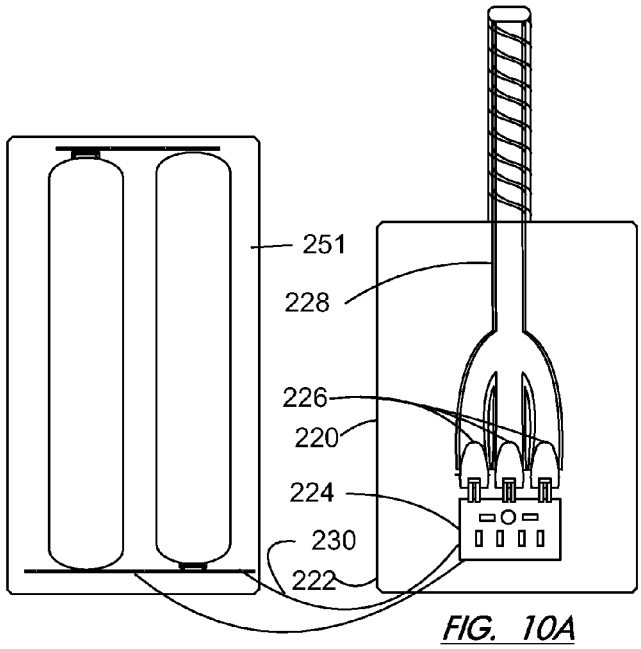
FIGS. 10A, 10B, 10C and 10D show a views of an embodiment which provides light through a fiber optic or fluid optic conduit.
Figure 10B:
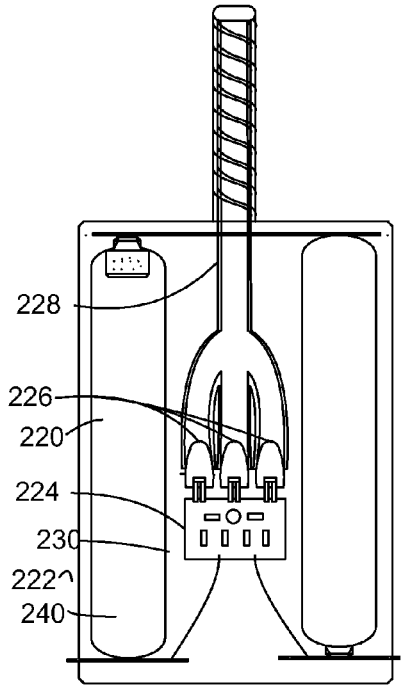
Figure 10C:
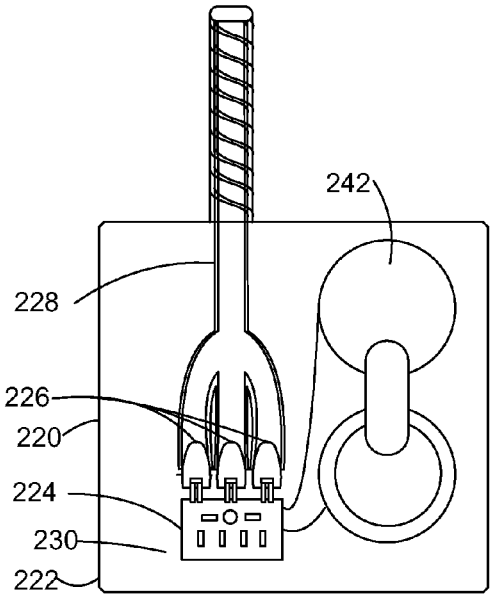
Figure 10D:
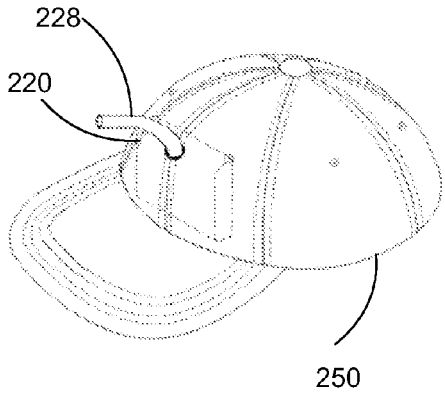

FIG. 10A shows yet another embodiment wherein a light unit 220 comprises a power supply casing, driver circuitry, an internally disposed illuminator, which in this embodiment comprises three LEDs 226, and a fiber optic, guided light optic, or fluid optic conduit 228 which is flexible at its outward end to enable the position of the light beam to be adjusted about both the vertical and horizontal axis. Preferably, a goose neck structure is provided to retain the desired position. The light unit 220 is attached to the inside of an article of clothing, in this case a baseball cap 250 by a cloth fastening system such as Velcro (not shown). Although in this embodiment, a cloth fastener is a preferred method for connecting the light unit 220 to the article of clothing, the clip and prong method used in other embodiments of the invention can also be employed. The outward end of the fiber optic, guided light optic or fluid optic conduit 228 extends to the outside of the baseball cap 250 through a small aperture (not shown) which may be reinforced if desired.

In this embodiment as shown in this FIG. 10A, the power supply 251 is located separately from the light unit 220, and connected by electrical wires 230. Alternate embodiments shown in FIGS. 10B and 10C employ type AAA batteries 240 in the same housing, and coin cell batteries 242 respectively. In this embodiment, the light source 226 is internally disposed within the power supply housing 222, and the fiber or conduit 228 selectively guides the light from an internal light source 226 to where needed. The advantage of this embodiment is a small, light and compact size which is more comfortable for the user, capable of being attached with cloth fasteners because if its reduced bulk and light weight, and which provides for a minimal aperture size and minimal protrusion of the fiber or conduit 228 on the outside portion of the baseball cap 250 or other clothing item. While this embodiment uses a flexible fiber/fluid optic, in an alternate embodiment the illuminator can be mounted on the end of a flexible shaft and receive electrical power from the power supply casing by electrical wires passing through said shaft.

It should be noted that throughout the figures and descriptions, the power supply casings contain space for batteries; however, in variations the batteries can be located separately from the power supply casing, and connected with wires which may be permanently fixed or detachable using a wire harness plugs or other methods commonly used to connect wires.

The instant invention has been shown and described herein in what is considered to be the most practical and preferred embodiments. It is recognized, however, that departures may be made therefrom within the scope of the invention and that obvious modifications will occur to a person skilled in the art.

I claim:

1. A light adapted to be attached to an apertured article of clothing, comprising:

a support structure, having at least a portion adapted to be placed hidden within the apertured article of clothing, having a depth beneath the article of clothing and a surface adapted to lie parallel to a human body portion;

an illuminator casing, having therein an illuminator adapted to emit a beam of light when electrically powered from a position in front of the article of clothing, attached to said support structure through a supporting coupling which permits said illuminator casing to be manually moved about at least one axis and maintained in position after manual movement, having an illuminator casing depth in front of the article of clothing, said illuminator depth being greater than the support structure depth and being supported in front of the article of clothing by said support structure;

an electrical switch, adapted to selectively control power to said illuminator, said electrical switch being operated by a manipulation of said illuminator casing;

said support structure comprising a detachable clamp, passing through at least one aperture in the article of clothing, providing a clamping force with respect to said illuminator casing, to thereby retain the article of clothing therebetween and maintain a relative position of said support structure and said illuminator casing with respect to the article of clothing.

2. The light according to claim 1, wherein said clamp is separable from said support structure and said illuminator casing, and comprises at least one extension, which provides a mechanical interconnection between said clamp and said support structure, to sandwich therebetween an inner edge of the aperture of the article of clothing.

3. The light according to claim 2, wherein said at least one extension on said clamp comprises an outer surface and a pair of members having snaps which mate to corresponding recesses on said support structure, comprising a power supply casing adapted to hold at least one of a battery and a connector adapted to interface with an external battery, providing electrical connections thereto, said battery having a thickness, a thickness of said power supply casing being no greater than approximately sum of the thickness of the battery, a wall thickness of the power supply casing, and a thickness of a mechanical interconnection portion of said power supply casing, wherein said snaps are inserted in said recesses to provide a mechanical connection, and wherein said clamp has an aperture larger than a diameter of the illuminator casing.

4. The light according to claim 2, wherein said at least one extension is attachable and detachable by mutual rotation.

5. The light according to claim 1, wherein said coupling provides a horizontal pivot axis about which the illuminator housing moves.

6. The light according to claim 1, wherein said coupling comprises a ball in socket mechanism providing freedom of movement about both horizontal and vertical axes for said illuminator housing.

7. The light according to claim 1, wherein said illuminator comprises at least one light emitting diode powered by an electrical voltage converter circuit from a battery.

8. The light according to claim 1, wherein a power supply for said illuminator is further adapted to be disposed within said illuminator casing on an outside portion of the article of clothing, said illuminator casing comprising a switch for activating and deactivating said illuminator.

9. The light according to claim 1, wherein said illuminator and a power supply for said illuminator are disposed on an inside portion of the article of clothing, said clamp being positioned outside the article of clothing, with a flexible, repositionable optic conduit for guiding light from said illuminator to a port through an aperture in and external to the article of clothing.

10. The light according to claim 1, wherein said electrical switch is actuated by changing an angle of inclination of said illuminator casing with respect to said support structure.

11. The light according to claim 1, wherein the article of clothing comprises a hat having a recess therewithin adapted to hold an auxiliary device, and wherein said support structure comprises an electrical connector adapted to mate with said auxiliary device.

12. The light according to claim 11, wherein said support structure comprises a power supply casing, and said auxiliary device draws power from said power supply casing.

13. The light according to claim 11, wherein said auxiliary device supplies power to said illuminator.

14. The light according to claim 1, wherein said supporting coupling comprises at least one sliding electrical contact, adapted to supply power over a range of inclination angles of the illuminator casing with respect to said support structure about the at least one axis.

15. The light according to claim 1, wherein said support structure comprises a surface disposed within the article of clothing, adapted to be maintained in position by a human forehead, wherein a weight of said illuminator casing is directed as a torque principally on the support structure and not principally on the article of clothing.

16. The light according to claim 1 wherein said clamp comprises one side of a hook and loop fastener and a mechanical interconnection and clamping force between said support structure and said illuminator casing are provided by connecting said one side of said hook and loop fastener to a corresponding other side of said hook and loop fastener, which is attached to the article of clothing.

17. The light according to claim 1, wherein said clamp comprises a magnet which is one of: attached to the support structure or placed on the article of clothing on a side opposite said support structure, said magnet providing said clamping force.

18. A light adapted to be attached to an article of clothing, comprising:

an illuminator casing comprising an illuminator adapted to emit a beam of light, a battery, and an electrical control adapted to control a supply of power from said battery to said illuminator;

a detachable clamp, having a pair of rectangular arms adapted to pass through a corresponding pair of rectangular apertures in the article of clothing, each of said arms having a split prong adapted for retaining a portion of said illuminator casing and allowing it to rotate about an axis, said arms maintaining said illuminator casing forward of the article of clothing, and transmitting a supporting force through the apertures within the article of clothing.

* * * * *